US005915857A

United States Patent [19]

Gallagher

[11] Patent Number: 5,915,857

[45] **Date of Patent: *Jun. 29, 1999**

[54] METHOD AND APPARATUS USING PINS TO HOLD AN ITEM TO BE MOUNTED IN A DISPLAY DEVICE

[76] Inventor: Gerald B. Gallagher, 9 Main St., Acton, Mass. 01720

[ * ] Notice: This patent is subject to a terminal disclaimer.

[21] Appl. No.: 08/254,277

[22] Filed: Jun. 6, 1994

Related U.S. Application Data

[63] Continuation-in-part of application No. 07/807,992, Dec. 16, 1991, Pat. No. 5,371,963.

[51] Int. Cl.[6] ..... A47G 1/06

[52] U.S. Cl. ..... 40/790; 40/768

[58] Field of Search ..... 40/663, 622, 200, 40/768, 769, 770, 721, 780, 781, 790, 158.1, 700

[56] References Cited

U.S. PATENT DOCUMENTS

| | | | |
|---|---|---|---|
| 743,831 | 10/1903 | Cota | 40/663 |
| 1,977,667 | 10/1934 | Breitkreuz | 40/373 X |
| 2,894,426 | 7/1959 | Rapata | 40/622 X |
| 3,206,882 | 9/1965 | Thatcher | 40/622 X |
| 3,339,302 | 9/1967 | Mallory . | |
| 3,371,439 | 3/1968 | Smith et al. . | |
| 3,643,362 | 2/1972 | Hackett et al. | 40/792 |
| 3,707,053 | 12/1972 | Itano . | |
| 3,932,259 | 1/1976 | Marini et al. . | |
| 3,994,088 | 11/1976 | Ohfuji . | |
| 4,005,539 | 2/1977 | Chamberlain | 40/622 |
| 4,045,897 | 9/1977 | Gates . | |
| 4,138,786 | 2/1979 | Smith . | |
| 4,157,626 | 6/1979 | Bedinghaus . | |
| 4,217,711 | 8/1980 | Spresser et al. | 40/781 X |
| 4,231,833 | 11/1980 | Lieberman . | |
| 4,250,640 | 2/1981 | Culhane | 40/790 X |
| 4,345,394 | 8/1982 | Sullivan . | |
| 4,356,649 | 11/1982 | Diamond et al. . | |
| 4,424,637 | 1/1984 | Leahy . | |
| 4,545,140 | 10/1985 | Winston . | |
| 4,629,152 | 12/1986 | Spilka | 40/790 X |
| 4,640,030 | 2/1987 | Wood et al. . | |
| 4,706,397 | 11/1987 | Hesener . | |
| 4,761,903 | 8/1988 | Cantrell . | |
| 4,794,714 | 1/1989 | Weisgerber . | |
| 4,825,574 | 5/1989 | George . | |
| 4,879,824 | 11/1989 | Galloway . | |
| 4,889,748 | 12/1989 | Dudley . | |
| 4,914,842 | 4/1990 | Lieberman . | |
| 4,947,565 | 8/1990 | Shadwell . | |
| 4,964,231 | 10/1990 | DeMaat . | |
| 4,967,499 | 11/1990 | Rosenberg . | |
| 4,991,329 | 2/1991 | Wilson . | |
| 4,991,330 | 2/1991 | Heidari . | |
| 4,991,336 | 2/1991 | Lucke . | |
| 4,996,784 | 3/1991 | Hsu . | |
| 4,998,361 | 3/1991 | Gordon . | |
| 4,998,362 | 3/1991 | Stewart et al. . | |
| 4,998,363 | 3/1991 | Vilims . | |
| 5,012,600 | 5/1991 | Wang . | |
| 5,020,252 | 6/1991 | DeBoef . | |
| 5,020,254 | 6/1991 | Sheppard . | |
| 5,025,581 | 6/1991 | Polzin . | |
| 5,148,618 | 9/1992 | Brewster . | |
| 5,199,681 | 4/1993 | Reidy | 40/790 X |
| 5,265,357 | 11/1993 | Yu | 40/781 X |
| 5,295,342 | 3/1994 | Roche et al. | 40/600 X |
| 5,323,552 | 6/1994 | Fritz | 40/776 X |

*Primary Examiner*—Milton Nelson, Jr.

[57] ABSTRACT

A system for mounting, storing, and quickly changing displays is provided. The use of pins which pass through mounting holes in either the margin of items to be displayed or through mounting holes in tabs attached to an item to be displayed is provided. The pins then anchor into holes in support materials which may be for example, a backing board, for example, a mat board, or for example, an easel. The dynamics of the mounting may be achieved by way of pins attached to the support material.

The system also provides for storage of additional items, which are held in place in storage by way of the same system of pins, shanks, mounting holes and anchoring holes and fixed pins.

3 Claims, 12 Drawing Sheets

METHOD AND APPARATUS USING PINS TO HOLD AN ITEM TO BE MOUNTED IN A DISPLAY DEVICE

RELATED APPLICATION

This application is a continuation in part of U. S. Patent application, Ser. No. 7/807,992 filed on Dec. 16, 1991 now issued as U.S. Pat. No. 5,371,963 on Dec. 13, 1994, by Gerald B. Gallagher for Display Apparatus for Desired Items with Easy Exchange of Desired Items, and with Protection from Ultra-Violet Light, all disclosures of which are incorporated herein by reference. This application is also related to U.S. Pat. No. 5,546,685 issued Aug. 20, 1996, filed Jun. 29, 1992, as a continuation in part of Ser. No. 807,992 filed Dec. 16, 1991, now issued as U.S. Pat. No. 5,371,963 on Dec. 13, 1994.

FIELD OF THE INVENTION

This invention relates to the field of display in mounting devices, including picture frames and the like, and more particularly to an apparatus to store and to mount, replace and exchange displays in the devices in a way that is both quick and effective so that the mounting system can be used time and again for several displays.

BACKGROUND OF THE INVENTION

The display of an item presented for view (sometimes "item","art", "art portion", or "artwork"), for example, in a picture frame, is generally accomplished by making the window in a mat slightly smaller than the paper, canvas, or whatever material on which the item presented for view is painted, printed, attached, or however joined, and attaching the item presented for view by tape, glue, etc. to the rear of the mat. The mat with the attached item is then mounted in a frame, with a transparent covering, glass, in front of the item, with a backing board behind the item, and with various forms of hardware to hold the sandwich of materials in the frame.

The method of making the window in the mat smaller than the item presented for view, and then supporting the item presented for view by attaching them to the mat by tape, glue, etc. is inadequate to display many items seriatim in a picture frame. For example, it is often desired to display in a picture frame a selected item temporarily, and then to exchange a new item for the old. More frequently than not, the item displayed costs less than the display apparatus and the labor time necessary to mount the display, and the use of tape or glue is an inconvenience when exchanging the items to be displayed. Further, if the same frame, mat, backing board, clips and other mounting materials are to be used for a different display, the various materials displayed will have to be stored separately from the frame materials, and are subject to damage, loss, etc.

For purposes of variety in displays, without the need for large expenditures of money, it is desirable serially to mount a plurality of items presented for view for display in a picture frame type display system and to be able to remove easily a first of the series and replace it with a second, third, et cetera, in a set of items.

SUMMARY OF THE INVENTION

A method of mounting an item for display, without the need to affix the item by glues, tapes or adhesives to another part of the mounting assembly, featuring easy substitution of a second, third, etc. display is provided. Also provided is a method to store other items to be viewed in the same system, with only one being visible at a time.

A display assembly with a mat having an opening forming a window for viewing the item presented for view, the art; potentially, also, a second mat, for the situation in which such second (double) mat is desirable; a backing board to form a back support; attachment means for selectively fastening the mat, the potential double mat, the item, the stored items, and the backing board to one another, are provided.

Pins inserted through mounting holes located in the margin of the item presented for view, or through tabs attached to an item presented for view, anchor the display to either the backing board or the mat by virtue of the pins being inserted into holes in the mat, the backing board or both. Pins may be of many shapes including the shape of a simple dowel, and a shape similar to the silhouette outline of a tall hat. The pins are designed so that the tube like portion, the shank, goes snugly through a mounting hole in the margin of the display, and then snugly into a hole in the backing board. In respect, for example, to the pin with the silhouette shape, the brim portion, (sometimes herein "head") being larger in diameter than the hole in the margin of the display, holds the display fast against the backing board, or the head being larger than the holes in the mat, the shank portion goes through the mat, and through the holding holes associated with the items to be displayed and anchors the mat and the items together.

The pins may be made of wood, plastic, aluminum, steel or just about any material and may be formed into a strip so that one, two, three or more protrusions having as a head the same joining strip. The base and pins may be formed by plastic injection molding, or by other convenient means.

The pins (and the respective cognate holes and recesses) may be of a variety of sizes and shapes, round, elongated, square, etc., as may seem suitable to address the weight, size, tear resistant characteristics of the paper, fabric or other material on which the image to be displayed is printed, photographed, bonded, reproduced, or however made part of or attached.

In the event that the margins out side the art work are not adequate to accommodate holes, tabs with holes may be attached at the margins of the art work. The pins also may be attached to the mat board, and also the pins may be formed with several pins having a common head.

The invention may also be used, for example, with an easel, in which the pins protrude from the top fixed horizontal member of the easel so that the pins may go through holes in the top margins of the items to be mounted in the display device.

BRIEF DESCRIPTION OF THE DRAWINGS

FIG. 5A is a side view of a top hat shaped pin.

FIG. 5B is a perspective view of a top hat shaped pin.

FIG. 5C is an end view of a top hat shaped pin.

FIG. 5D is an end view of a top hat pin with an off center placement of the shank.

FIG. 5E is a perspective view of a square pin head and shank.

FIG. 5F is a view of a race track shaped pin and shank.

FIG. 5G is a perspective view of a dowel shaped pin.

FIG. 5H is an end view of a dowel shaped pin.

FIG. 5I is a side view of a pin assembly having not less than one shank joined by a common head.

FIG. 5J is an end view of a not less than one shank pin assembly.

FIG. 5K is a view of an elongated race track shaped pin, head and shank.

FIG. 5L is a perspective view of the rear of a mat board with pins attached.

DETAILED DESCRIPTION

Figure 1:
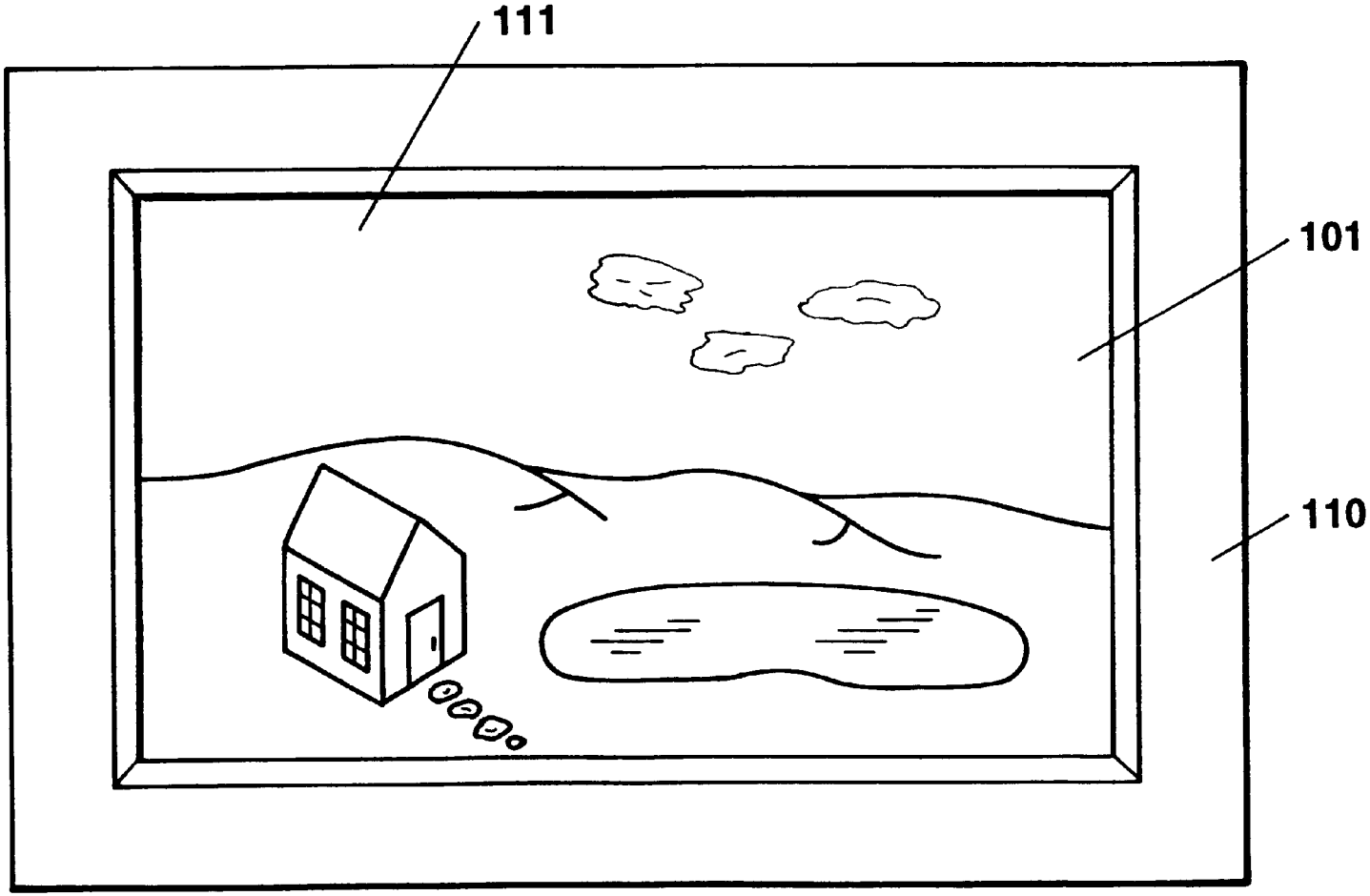
FIG. 1 is a front view of a mat board over the item to be mounted, and the art portion is visible.

In order to further illustrate the advantages and features of the invention, reference should be made to the following detailed description in connection with the accompanying drawings. Throughout the drawings, like reference numbers refer to like features of the present invention represented in the several views. The detailed description encompasses a number of exemplary embodiments, as shown in the drawings.

Beginning with FIG. 1, there is shown only the viewable section, 101, of the item to be mounted in a display, 100, (shown in FIG.2) in the window, 111, of the mat, 110.

Figure 2:
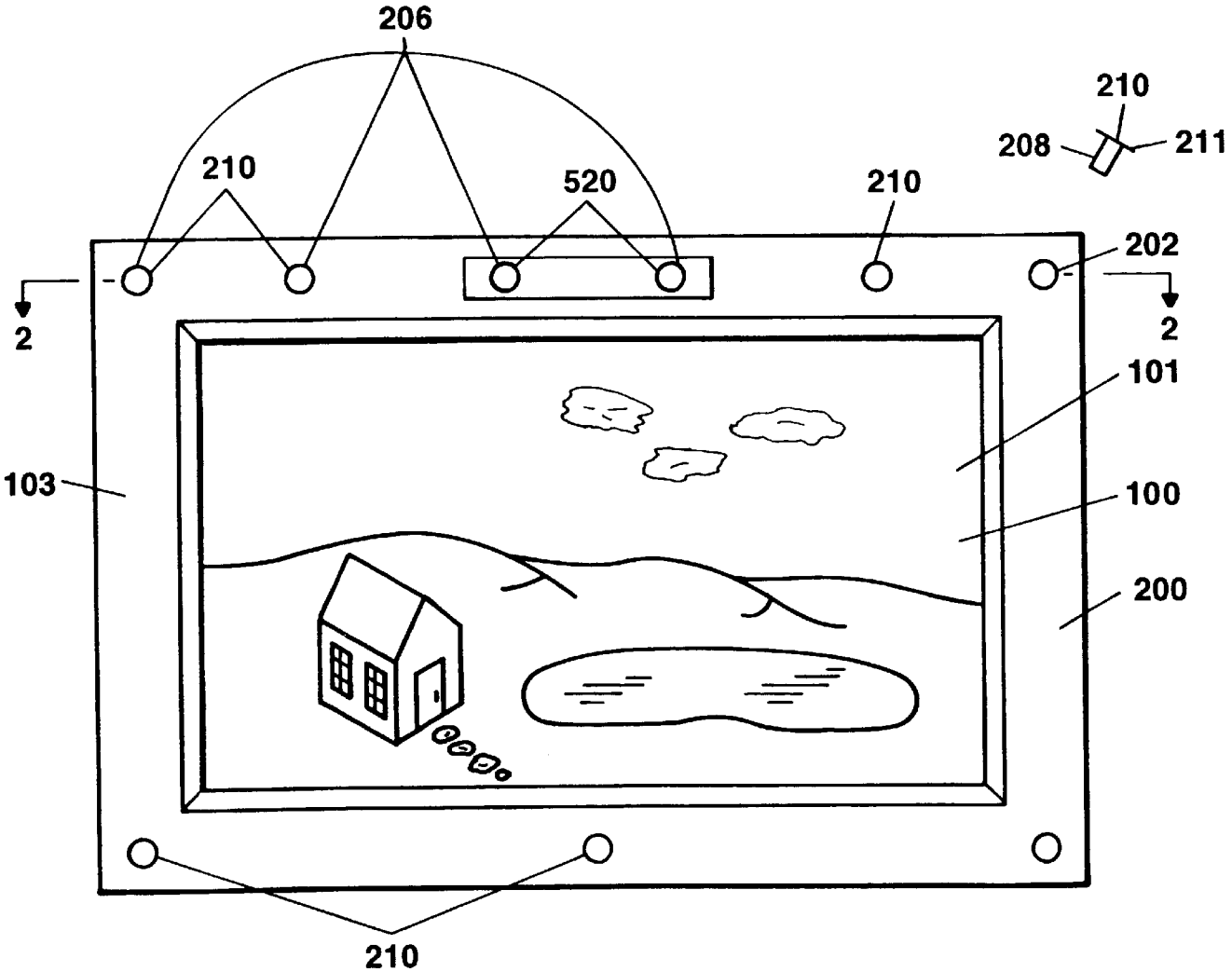
FIG. 2 is a front view of the item to be mounted in a display showing holes in the margin.

Turning now to FIG. 2 there is shown a front view of the item to be mounted in a display, 100; the viewable section, 101; the perforated margin, 103; and the mounting holes, 202. Also shown are nine mounting pins (Generic 206) specific, 211, and in as much as eight are inserted in the mounting holes, only the heads, 210, show for those eight, but one exemplary pin, on the top right, is shown adjacent to the mounting hole, 202, and that unmounted pin, 211, shows its head, 210, and its shank, 208. Also shown in the top center is a pin assembly of not less than one shank 520.

Figure 3:
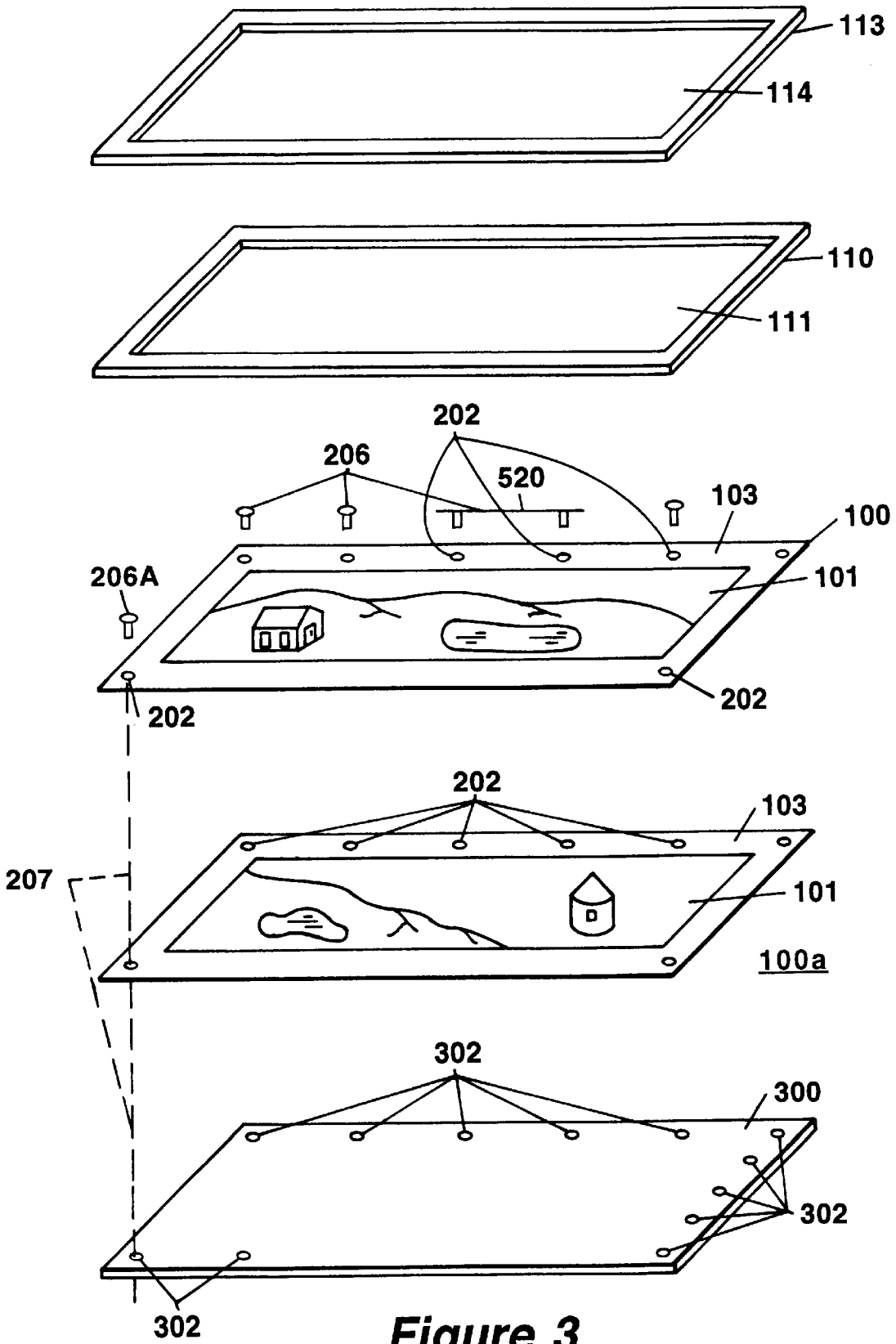
FIG. 3 is an exploded assembly drawing of the apparatus.

Turning now to FIG. 3, there is shown an exploded assembly drawing of the apparatus, showing an optional double mat board 113, the window 114 in the double mat board. The figure also shows a mat board, 110, with the window, 111 in the mat. Also shown is the entirety of the face of the item to be mounted in a display 100 including the viewable section 101, the perforated margin 103, and the mounting holes 202. A second item to be mounted, which is pictured as in storage, is shown as 100*a*, but in as much as the parts are very similar to those in the first of the items to be mounted in a display, the same numbers are assigned to the parts. A backing board 300 is also shown, and the holes in the margin are numbered 302. The number of anchoring holes in the margin of the backing board are more than required for the mounting as shown in FIG. 3. Extra holes are shown in as much as the backing board, 300, may be used for different formats, and may be mounted in either the vertical or horizontal axis. Two forms of mounting pins 206 are also shown: mounting pin of the top hat silhouette 211, and pin assembly of not less than one shank 520. The mounting pins 206 (generic number designation: 206) fit through the holes 202 in the margins of the items to be mounted in a display, and into holes 302 in the backing board 300. One such pin 206 A is shown with a dotted line 207 showing how the shank 208, fits into the respective holes. Backing board 300 may consist of, for example, so called foam board, or for example, so called corrugated paper board, or for example, so called composition board, or for example, some other material. The holes 202 in the item to be mounted in a display 100 and the holes 302 in the backing board 300 are corresponding to one another, and both the holes 202 and 302 correspond to the shank 208 of the pin 206.

Figure 4:
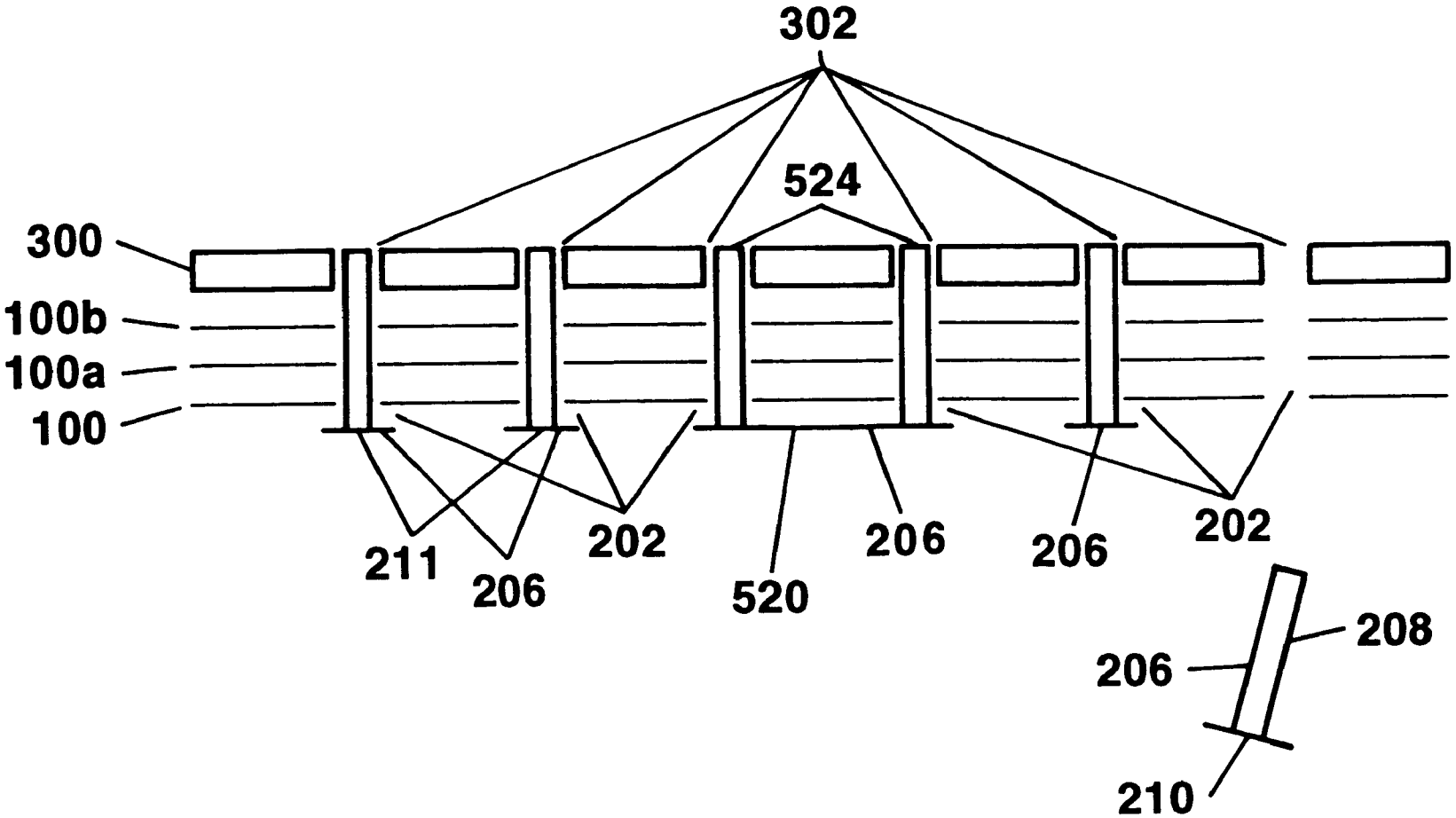
FIG. 4 is a cross sectional view of FIG. 2, along the line designated "2—2".

Turning now to FIG. 4, there is presented a cross section of FIG. 2, on line 2—2. Holes 302 are shown in the backing board 300. Pins 206 penetrate holes 202 in the margin of the item to be mounted in a display 100. A pin of not less than on shank 520 is also shown, together with the shanks, 524, penetrating the other parts of the assembly. FIG. 4 also shows the edges of items 100*a* and 100*b* which items are shown as being stored in the system. Either of which items 100*a* or 100*b* may be shown at other times. Alternatively, pins 206 pass through holes in tabs 602, FIG. 6A and FIG. 6B. In the case in which the mounting holes are not in the margin of the item to be mounted in a display, the perforated tabs 602 may be attached to an item to be mounted in a display and the holes 602 fulfill the same function as the holes in the margins 202.

Figure 5A:
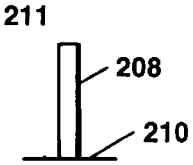
FIGS. 5A, 5B, 5C, 5D, 5E, 5F, 5G, 5H, 5I, 5J, 5K, and 5L are detailed views of various examples of the generic pin, number 206.
Figure 5B:
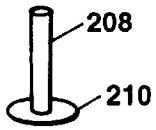
Figure 5C:
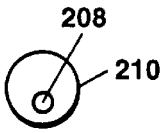
Figure 5D:
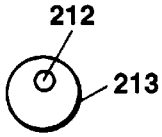
Figure 5E:
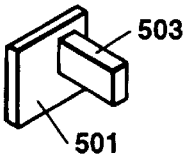
Figure 5F:
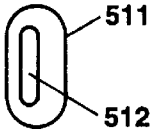
Figure 5G:
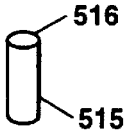
Figure 5H:
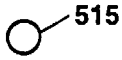
Figure 5I:
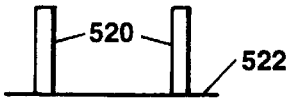
Figure 5J:
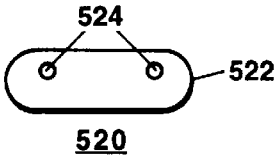
Figure 5K:
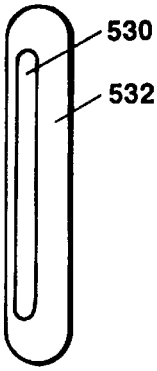
Figure 5L:
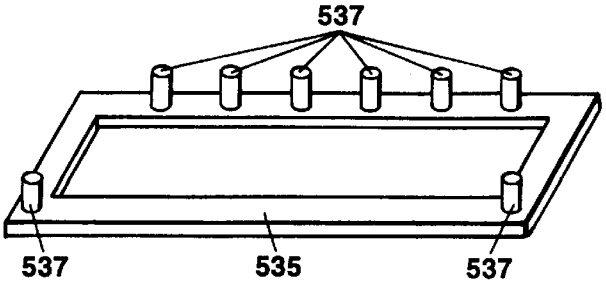

Turning now to the page marked FIG. 5A to 5L, there is shown several exemplifications of the generic pin 206. The general pin 206 may be for example of a top hat silhouette. In FIG. 5A, there is shown a side view of the top hat silhouette pin 211 along with the head 210 shank 208. FIG. 5B shows a perspective of the pin 211 looking down on the end of the shank 208 of the pin 209 and the underside of the head 210, as it joins the shank 208. FIG. 5C shows the pin 211 from a view point directly in line with the bottom of the shank, 208, and the full underside of the head, 210, of the pin. FIG. 5D shows a similar view as the view of FIG. 5C except that FIG. 5D shows that the shank portion 212 of the pin may be off center from the center of the head 213. FIG. 5E gives a side perspective of a pin with a square shaped shank, 503, and a rectangular shaped head, 501. FIG. 5F shows a pin with a race track shaped head 511 and shank 512. FIG. 5G gives a perspective view of a pin 515 which is a simple dowel, showing the end 516 of the dowel and the side. FIG. 5H gives an end 516 view of the dowel shaped pin 515. FIG. 5I, gives a side view of not less than one shank assembly whereby the not less than one shanks 524 are joined together by one head 522. As a concrete example, two pins 524 are shown with common head 522. Alternatively, 3, 4, or more shanks may be formed with a common head. FIG. 5J gives a bottom view of the same not less than one shank 520 pin-shank arrangement as in FIG. 5I, viewing the arrangement from the bottoms of the shank portion 524 of the pins, and the bottom of the head 522. FIG. 5K shows an arrangement whereby a pin similar to that shown in FIG. 5F is much elongated, so that the pin, shank 530 and head 532, may be several inches in length. Turning now to FIG. 5L there is shown the reverse side of a mat board, 535, with the pins 537 attached directly to the mat board. For example, the pins 537 may be simple dowels fastened to the back of the mat board, and extending through the holes in the margin of the art work and into holes in the backing board. The pins shown in FIGS. 5A to 5L are but some examples of innumerable alternative forms of pins. Please note that the shank can be off center from the head and the head, when used, while it may be paper thin, is larger in diameter than the individual holes in the art, or the tabs, or the backing board. FIG. 5 also shows a simple dowel 515, with no head as being a pin.

Figure 6A:
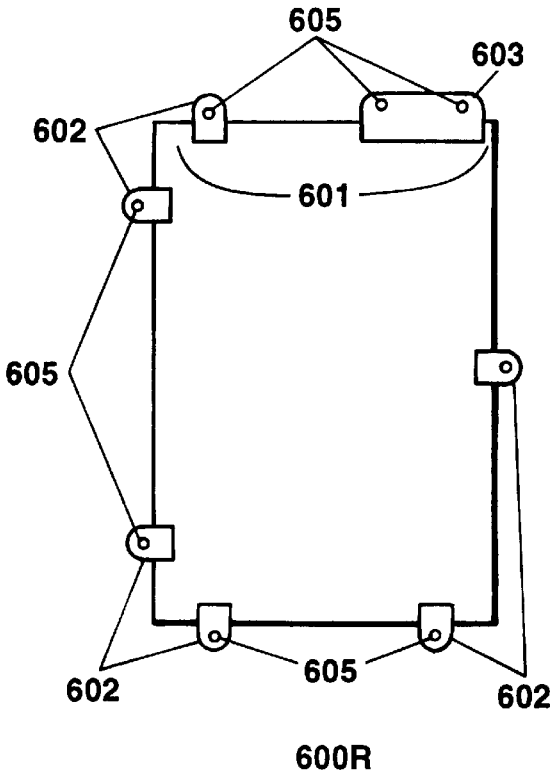
FIG. 6A is a back view of an item to be mounted in a display, showing tabs with holes.
Figure 6B:
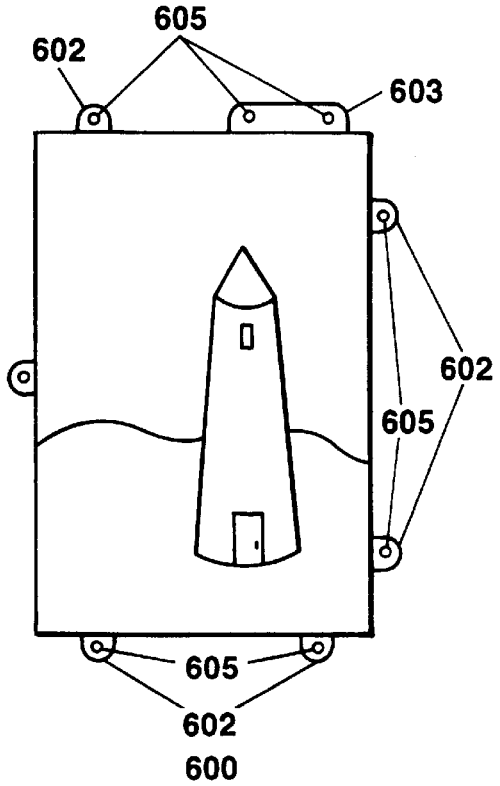
FIG. 6B is a front view of an item to be mounted in a display showing tabs with holes.

Turning now to FIG. 6A. there is shown a back view of an exemplary item to be mounted in a display 600R with the shorter dimension 601 across the top. The item to be mounted in a display 600 does not have a sufficient margin to accept holes for the pins. In FIG. 6A the entirety of the tabs 602, are shown. FIG. 6B shows the face of the item to be mounted in a display 600 with such part of the tabs, 602, as extend beyond the edge of the items to be mounted 600. The pins 206 pass through the holes 605 in the tabs 602 and then into the holes 302 in the backing board 300. The pins 206 thereby lock the item to be mounted in a display in a fixed position in relation to the backing board 300 and then to a mounting device.

Figure 7:
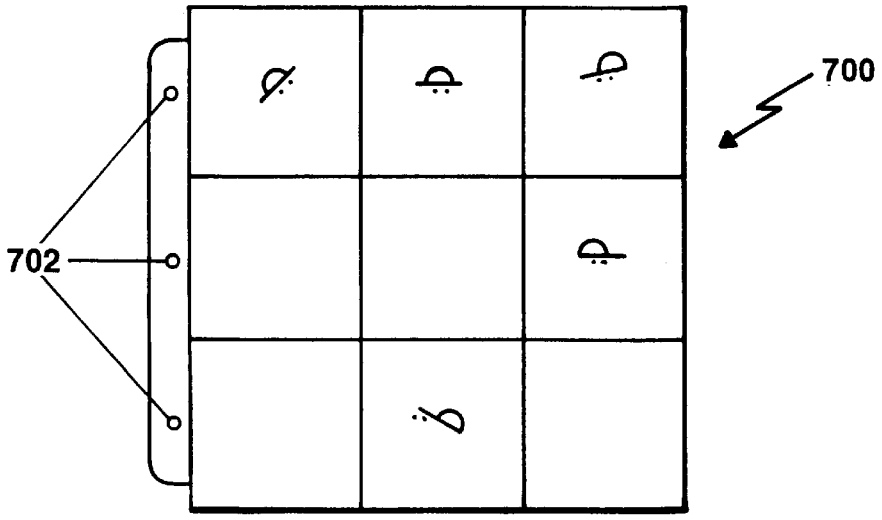
FIG. 7 is a view of one type of album page, with holes in the margin, which page can be mounted in the apparatus.

Turning now to FIG. 7 there is shown an example of an album page 700 which can be mounted in a display in the system. The holes 702 in the margin correspond to the holes 202 which are in margins of an item to be mounted in a display 100, and to holes in tabs, 602 for the purpose of being secured by pins 206 passing through the holes 702.

Figure 8:
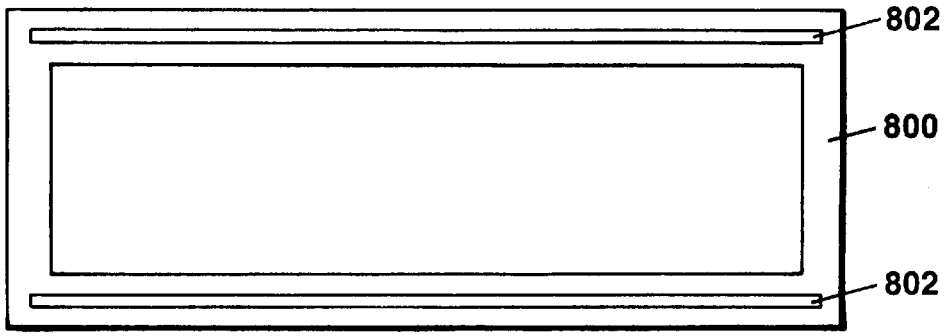
FIG. 8 is a rear view of a mat board with recesses to accommodate the heads of pins.

Turning now to FIG. 8 there is shown the reverse side of a mat board, 800, with recesses 802 in the board to accommodate the heads of pins inserted into mounting holes. As in FIG. 3, the heads of the pins are between the item to be mounted in a display, 100, and the mat board 110. For example, mat board 800 may be used for mat board 110. The heads 210 of the pins 206 fit into the recess 802, in the mat board 110, 800.

Figure 9:
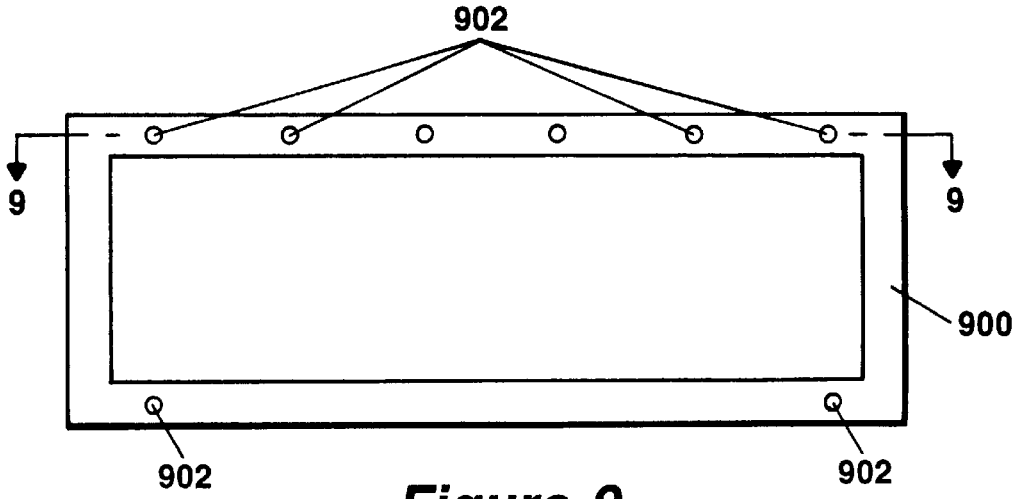
FIG. 9 is a perspective view of a mat board with its margin perforated to accept mounting pins.

Turning now to FIG. 9, there is shown a mat board 900 with mounting holes 902 to receive mounting pins 206. The shanks 208 of the pins go through the mounting holes 902 in the mat board 900, and for example, through the mounting holes 202 in the margins of an item to be mounted in a display 100 and into the anchoring holes 302 in the backing board 300. The mat board 900 may be used in conjunction with a double mat 113 which will cover both the holes and the pins, and with items to be stored 100*a* and 100*b* as shown in FIG. 10.

Figure 10:
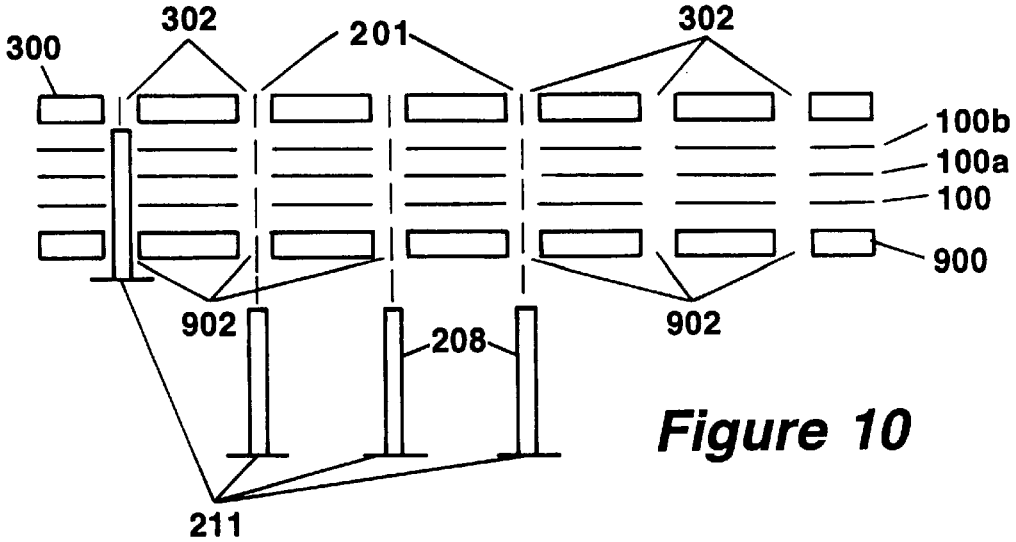
FIG. 10 is a cross section of a assembly of the apparatus using the mat board along line 9—9 of FIG. 9.

Turning now to FIG. 10, there is presented a cross section of an assembly utilizing the mat shown in FIG. 9 on line 9—9. Holes 902 in the mat 900 are shown, with pins 211 positioned to go into the mounting holes 202 in the item to be mounted in a display 100, and the two shown items to be stored 100*a*, and 100*b*. The anchoring holes 302 in the back board 300 are shown as is the line of connection 207 showing how the shanks fit into their respective holes. The holes 902 in the mat board 900, and the holes 202 in the item to be mounted in a display 100, and the holes 202 in the item in storage 100*a*, and the holes 302 in the backing board 300 are all corresponding holes, and all correspond in size to the shank 208 of the mounting pin 211.

Figure 11:
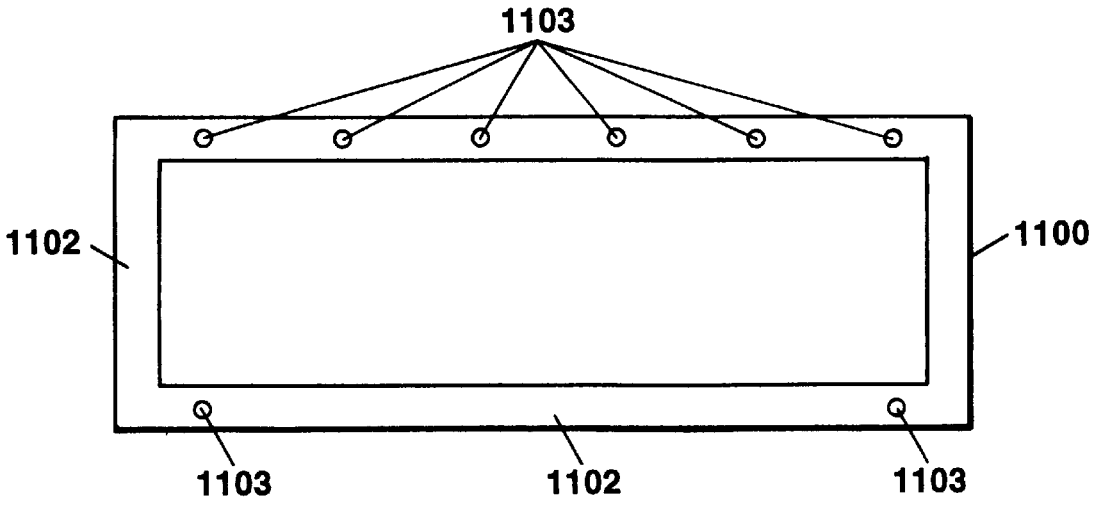
FIG. 11 is a back view of an item to be mounted in a display, showing a perforated reinforcing strip at the margin.

Turning now to FIG. 11, there is a rear view showing the reverse side of an item to be displayed 1100. A reinforcing strip 1102, is shown attached, as by adhesive, for example, to the back of the item to be displayed 1100. Mounting holes 1103 in the reinforcing strip accept pins 206.

Figure 11A:
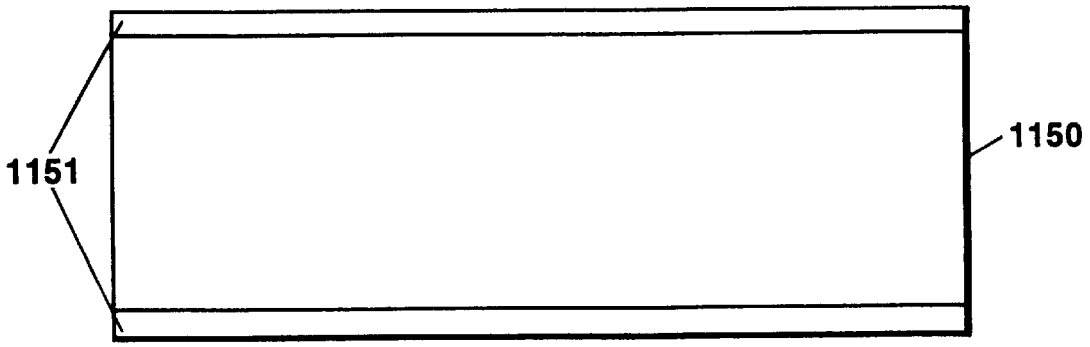
FIG. 11A is a back view of an item to be mounted in a display, showing a reinforcing strip at the margin.

Turning now to FIG. 11A, there is shown an item to be mounted in a display 1100 with a reinforcing strip 1106 attached to two margin of the item to be mounted.

Figure 12:
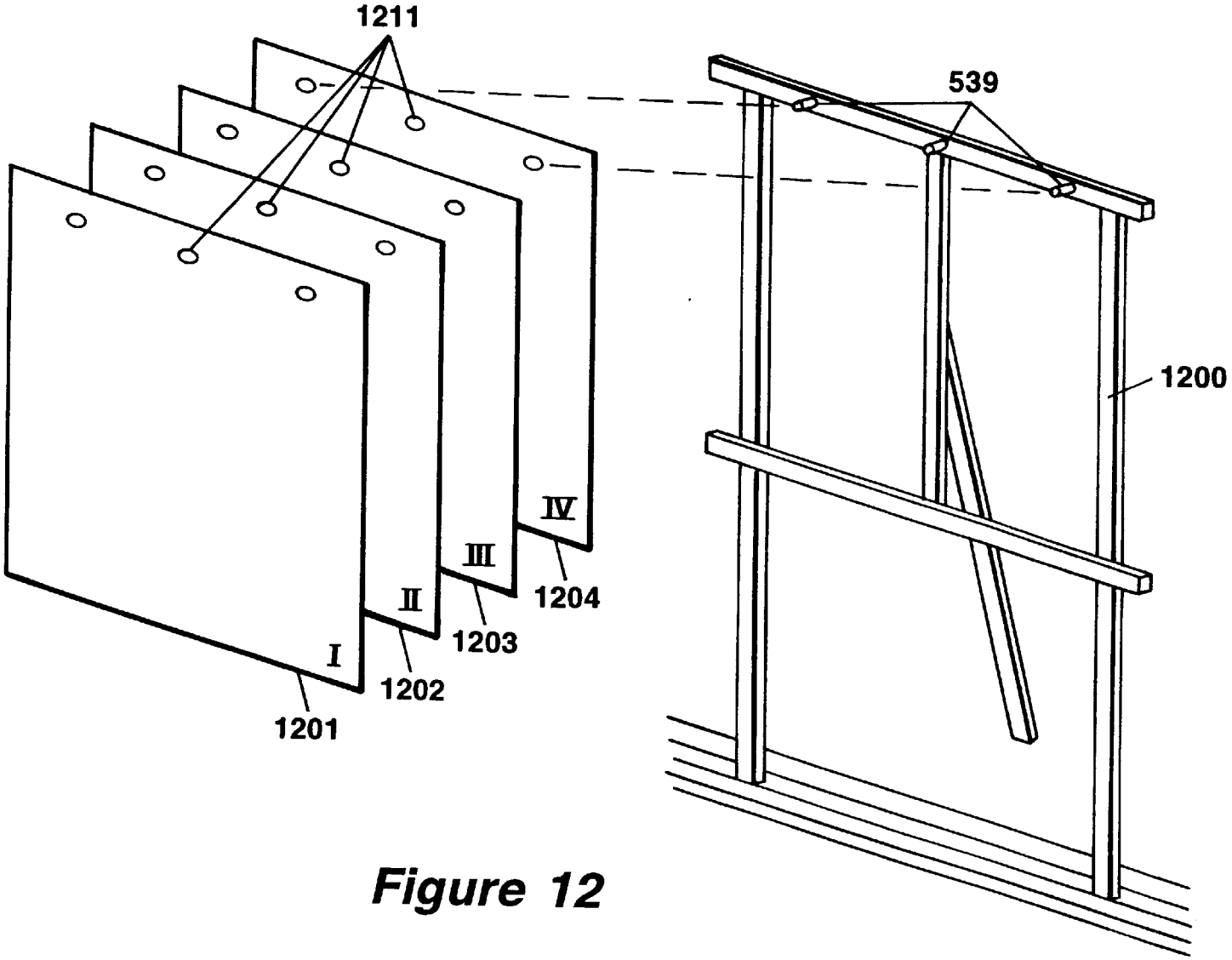
FIG. 12 is an exploded view of an item to be mounted in a display, showing the said item mounted on an easel format.

Turning now to FIG. 12 there is shown a perspective view of an item to be mounted in a display 1201, items in storage 1202, 1203, 1204, along with the easel, 1200. The pin 539, (generic 206), on the easel format is shown together with the line of connection 1211.

Figure 13:
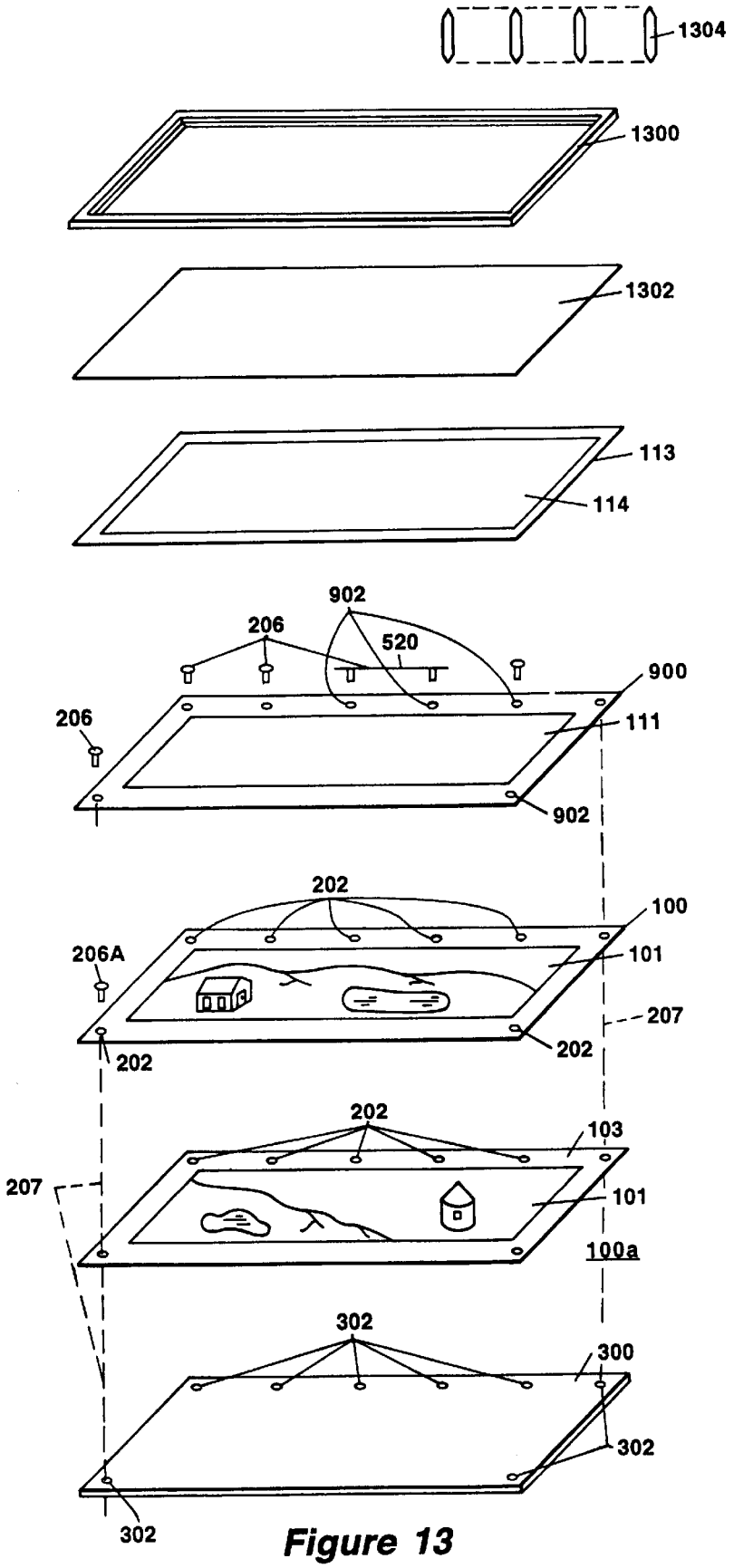
FIG. 13 is view of a frame display device using pins which are not attached to structural material.

Turning now to FIG. 13, there is shown an exploded view of a mounting device, showing the frame 1300, the mounting clips 1304, the optional glass 1302, the optional double mat 113, together with the window in the double mat 114. The pins shown are identified by the generic 206, and one pin of the pin strip design 520 is also shown with the specific number. The mat board with the perforated margin 900 is shown along with its holes 902. The item to be mounted in a display 100 is shown together with its mounting holes 202, and also the item in storage 100*a* is shown. The backing board 300 with the mounting holes 302 is shown. To shown the direction of the pin in mounting the material and holding them in place, the line 207 is shown.

Figure 14:
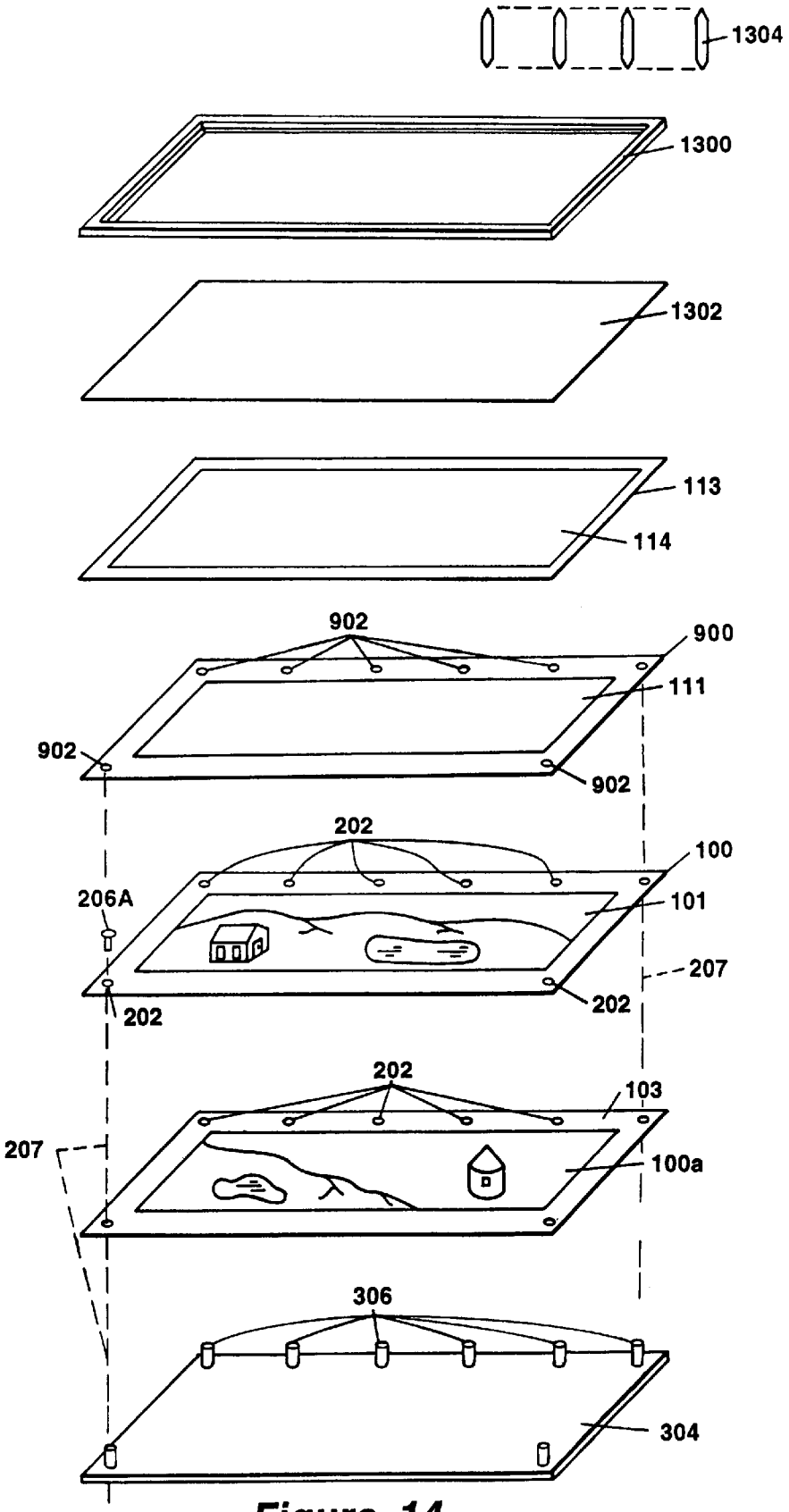
FIG. 14 is view of a frame display device in which the pins are attached to the backing board.

Turning now to FIG. 14 there is shown an exploded view of a mounting device, showing the frame 1300, the mounting clips 1304, the optional glass 1302, the optional double mat 113, together with the window in the double mat 114. The mat board with the perforated margin 900 is shown along with its holes 902. The item to be mounted in a display 100 is shown together with its mounting holes 202, and also the item in storage 100*a* is shown. The backing board 304 with the pins 306 attached to it is shown. To shown the direction of the pin in mounting the material and holding them in place, the line 207 is shown.

Figure 15:
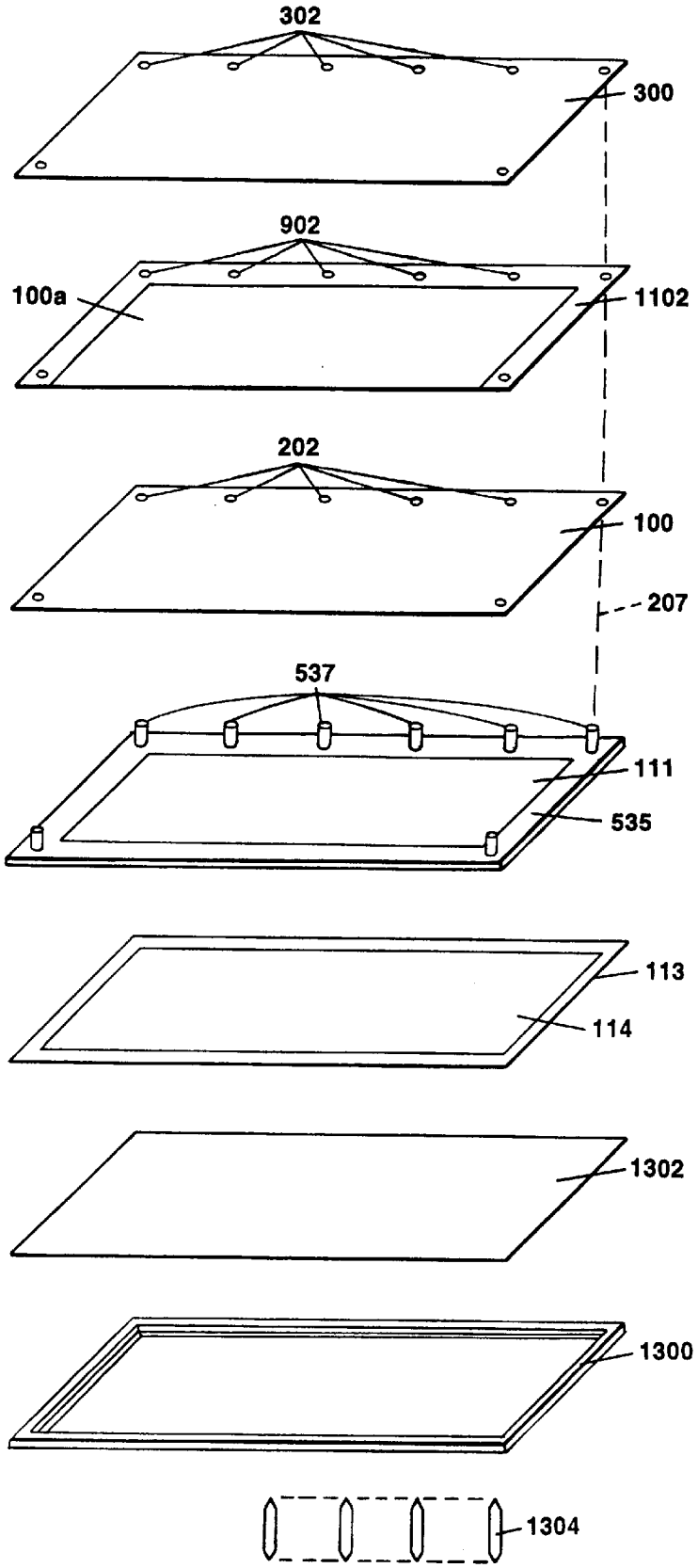
FIG. 15 is view of a frame display device in which the pins are attached to the mat board.

Turning now to FIG. 15 there is shown an exploded view of a mounting device, showing the frame 1300, the mounting clips 1304, the optional glass 1302, the optional double mat 113, together with the window in the double mat 114. The reverse side of the mat board 535 with the pins attached 537 is shown. The back of the item to be mounted in a display 100 is shown together with its mounting holes 202, and also the item in storage 100*a* is shown. Together with the item in storage 100*a*, the perforated reinforcing strip 1102 is shown. The backing board 304 with the mounting holes 302 to receive the pins is shown. To shown the direction of the pin in mounting the material and holding them in place, the line 207 is shown.

FIRST EXEMPLARY EMBODIMENT

Useful for the understanding of this embodiment will be FIGS. 1, 2, 3, 4, 5A, 5B, 5C, and 5J.

Beginning with FIG. 1, there is shown a mat board 110, a window 111 in the mat, and the viewable section 101 of the item to be mounted in a display 100. A portion of Item 100 in FIG. 1 is behind mat 110 and is therefore hidden in FIG. 1, but shows in FIG. 2.

In FIG. 2 there is shown a front view of the item to be mounted in a display 100 with the viewable section 101 with the mounting hole 202 and the heads of pins 210 in some of the mounting holes. Also shown in the upper right is pin 211 which has not been mounted in a display in the adjacent hole 202. The pin, for example, may be of the top hat silhouette variety FIG. 5A, 5B, 5C. The pin 211 is shown in profile, as is the shank 208. Also shown in the top center is a pin assembly of not less than one shank 520.

Turning to FIG. 3, constituent parts of this exemplary embodiment are shown in exploded form. The optional double mat 113 is shown with its window 114 which is slightly larger than the window 111 in the mat 110. Mat 110 is shown along with mat window 111. The pins 206 (for example top hat silhouette variety 211) are above item to be mounted in a display 100 and the item to be stored 100*a*. Also shown is the specific pin assembly of not less than one shank 520. The item to be mounted in a display 100, the viewable section 101 together with the margin holes 202 are also shown. A second item to be mounted in a display, which is pictured in storage, is shown as 100*a*. The backing board 300 with the anchoring holes 302 are also shown.

FIG. 4 shows the embodiment as assembled along a cross section of FIG. 2 on line 2—2. Where item to be mounted in a display 100 has adequate margins outside the viewable section, shanks of the generic pins 206, of the specific format 211 and 520 and are placed through holes 202 in the margins of the item 100 and then into the matching and cognate holes in 100*a*, 100*b*, (100*a* and 100*b* being stored displays) and then into the anchoring holes 302 in the backing board, 300. The stored art, for example, items 100*a*, 100*b* are mounted so analogously to item 100 as to need no other numbering to show mounting details. One pin (Generic 206) 211 is shown as not mounted. The head of that pin 210 and the shanks 208 are shown.

The mat 110 FIG. 1, as an option, may be placed over the front of the item to be mounted in a display so that the heads of the pins are covered from view.

SECOND EXEMPLARY EMBODIMENT

Useful for the understanding of this embodiment will be FIGS. 2, 3, 5L, 8 & 15.

Turning to FIG. 5L the mat board 535 with the attached pins 537 are show example, 37 may, for example, be attached by adhesives, or for example, by being integral to the mat board in the event that the mat board is cast as one piece, or for further example, by other means. The pins are inserted in the mounting holes 202 in the margins of the item to be mounted in a display 100 and then optionally, through the holes in the margin of the item to be stored, 100*a*, 100*b*, and then through the mounting holes 302 in the backing board 300.

FIG. 15 shows this embodiment as encompassed in a display device. FIG. 15 also shows a frame, 1300, mounting clips 1304,to fit the back of the frame and lock the assembly, optional glass 1302, and the optional double mat 113.

THIRD EXEMPLARY EMBODIMENT

Useful for the understanding of this embodiment will be FIGS. 1, 2, 3, 4, 5A, 5B, 5C, 5J, and 8.

Turning to FIG. 8 there is shown a mat board 800 with recesses 802 to accommodate the heads of pins 206 used to anchor an item to be mounted in a display 100. In the event that protrusion of the heads of the pins would otherwise cause a bulging of the mat board 110, the recess 802 is designed to accommodate the heads 210 of the pins. Continuing with the mounting arrangement set forth in FIG. 4, as explained in the First Exemplary Embodiment, the dynamics of this embodiment are set forth. FIG. 3 will help illustrate this embodiment, because if the mat board with the recesses 800 is substituted for the mat board 110 in FIG. 3, the embodiment is illustrated.

In short, the Third Exemplary Embodiment, is essentially the same as the First Exemplary Embodiment, except that the mat board 800 as shown in FIG. 8 with the recesses 802 to accommodate the heads 210 of the pins 206, is substituted for the mat board 110 shown in FIG. 1.

FOURTH EXEMPLARY EMBODIMENT

Useful for the understanding of this embodiment will be FIGS. 3, 5, 6A, and 6B.

Turning now to FIGS. 6A and 6B there is shown an item to be mounted in a display which may not have margins adequate for mounting holes or there may be a desire not to perforate the margins of the material. In this case it is possible to attach perforated tabs 602 to the item to be mounted in a display 600 and then to put pins 206 through the mounting holes 605 in the tabs 602 and into the anchoring holes 302 in the backing board 300. As an option the attached perforated tab with not less than one mounting hole 603 may be used. As an option, the mat 110 or the mat 900 may be placed over the front of the assembly.

FIFTH EXEMPLARY EMBODIMENT

Turning now to FIG. 7 there is shown an example of a page from a collector's album with materials for viewing contained in it. The materials for viewing may be, for example, inserted in pockets in the album page, may be, for example, attached to the album page by adhesives, the page itself may be, for example, the material to be displayed. By inserting pins 206 into the mounting holes 702 then into the holes 302 in the backing board 300, the album page 700 may be mounted in the system. As an option, the mat 110 or the mat 900 may be placed over the front of the assembly. Mounting holes 702 may have been formed in album page 700 for the purpose of attaching album page 700 into an album.

SIXTH EXEMPLARY EMBODIMENT

Useful for understanding this embodiment will be FIG. 12.

Turning to FIG. 12, there is shown an item to be mounted in a display 1201, items in storage 1202, 1203, 1204, which items in storage are subsequently to be displayed. The top part of an easel 1200 is shown along with the pins 539, (generic 206), projecting from the front of the easel. The line of connection 1211 of a pin attached to the easel is shown, indicating the line by which the various items, 1201 thought 1204 are held in place relative to one another and relative to the easel. When the display usefulness of the item to be mounted in a display 1201 is fulfilled, then 1201 may be removed from the assembly, and the item in storage, 1202 will immediately come into view, and so sequentially for items 1203 and 1204.

What is claimed is:

1. A display apparatus, comprising:

at least one pin;

a support material, said support material having at least one hole therein, a selected pin of said at least one pin passing through a corresponding hole of said at least one hole in said support material and passing through a corresponding hole in an item to be mounted in said display apparatus; and, a frame, said frame holding said support material, said pin holding said support material and said item to be mounted in fixed relationship to each other, to form a single unit having said frame, said support material and said item to be mounted held together as said single unit;

wherein said at least one pin is at least two shanks joined by a strip to form a pinstrip unit, and said at least two shanks penetrate at least two corresponding holes of said at least one hole in said item to be mounted in a display device and said support material, and said strip holds said at least two shanks of said at least one pin, said support material, and said item to be mounted as said single unit.

2. A display apparatus, comprising:

at least one pin;

a support material, said support material having at least one hole therein, a selected pin of said at least one pin passing through a corresponding hole of said at least one hole in said support material and passing through a corresponding hole in an item to be mounted in said display apparatus;

a frame, said frame holding said support material, said pin holding said support material and said item to be mounted in fixed relationship to each other, to form a single unit having said frame, said support material and said item to be mounted held together as said single unit, and;

at least one additional item to be mounted in a display device, with a corresponding hole in the at least one additional item to be mounted in a display device, said corresponding hole aligned to receive said at least one pin, to store the at least one additional item out of view, behind said item to be mounted in a display device.

3. A display apparatus, comprising:

at least one pin;

a support material, said support material having at least one hole therein, a selected pin of said at least one pin passing through a corresponding hole of said at least one hole in said support material and passing through a corresponding hole in an item to be mounted in said display apparatus;

a frame, said frame holding said support material, said pin holding said support material and said item to be mounted in fixed relationship to each other, to form a single unit having said frame, said support material and said item to be mounted held together as said single unit, and;

said at least one hole in said support material being a first plurality of holes, said first plurality of holes arranged in a first pattern for a first mounting format, and said at least one hole in said support material being at least a second plurality of holes, said at least a second plurality of holes arranged in at least a second pattern for at least a second mounting format, a selected one of said at least a second mounting format being appropriate for a selected item to be mounted in a display device.

* * * * *